US005416793A

United States Patent [19]

Hugo et al.

[11] Patent Number: 5,416,793

[45] Date of Patent: May 16, 1995

[54] INDUCTION MELTING APPARATUS SEALED AGAINST THE ATMOSPHERE

[75] Inventors: Franz Hugo, Aschaffenburg; Hans G. Fellmann, Obertshausen, both of Germany

[73] Assignee: Leybold Durferrit GmbH, Cologne, Germany

[21] Appl. No.: 62,123

[22] Filed: May 14, 1993

[30] Foreign Application Priority Data

Aug. 26, 1992 [DE] Germany ..... 42 28 402.3

[51] Int. Cl.[6] ..... F27D 3/00

[52] U.S. Cl. ..... 373/142; 373/156; 373/158

[58] Field of Search ..... 373/140, 141, 142, 72, 373/151, 156, 158; 75/10, 15, 10.18

[56] References Cited

U.S. PATENT DOCUMENTS 2,763,903 9/1956 Herres ..... 373/72
3,702,368 11/1972 Hukin ..... 373/156
4,562,943 1/1986 Freytag et al. ..... 373/142
4,738,713 4/1988 Stickle et al. ..... 75/10.18
5,121,406 6/1992 Hugo et al. ..... 373/142

FOREIGN PATENT DOCUMENTS 3026720 2/1982 Germany .
4117470 1/1992 Germany .

*Primary Examiner*—Bruce A. Reynolds
*Assistant Examiner*—Tu Hoang
*Attorney, Agent, or Firm*—Felfe & Lynch

[57] ABSTRACT

A crucible 1 of an induction melting apparatus has a cover 3 closing the crucible off hermetically and having a connection 5 for attaching the cover to a vacuum source 6. At the bottom the crucible 1 has a prolongation 7 in which a mold 9 is sealingly disposed. Thus, the mold 9 is evacuated together with the crucible 1 so that a vacuum chamber enveloping the crucible 1 and the mold (9) is unnecessary.

8 Claims, 1 Drawing Sheet

INDUCTION MELTING APPARATUS SEALED AGAINST THE ATMOSPHERE

BACKGROUND OF THE INVENTION

The invention relates to an induction melting furnace sealed against the atmosphere and having a connection for attachment to a vacuum source or inert gas source, for melting reactive metals of high melting point, which has an unlined melting crucible of metal within an induction coil, and a casting mold disposed beneath the crucible under an outlet.

Such an induction melting apparatus is described, for example, in U.S. Pat. No. 5,121,406. In it the crucible and the mold are disposed one above the other in a relatively large chamber so that air can be excluded from the molten metal during the melting and during the filling of the mold.

The crucible is in the form of a so-called "cold induction crucible" and has a wall formed of individual palisades. The palisades consist usually of copper and are water-cooled. A typical embodiment of such a "cold induction crucible" is described in U.S. Pat. No. 4,738,713. In this patent it is also stated that, for the performance of the remelting and casting the induction crucible and the mold must be contained in an air-tight chamber.

The known induction melting apparatus are relatively bulky and expensive to manufacture due to the chamber necessary for keeping the air out. Also, to produce a vacuum a comparatively large amount of air has to be aspirated out of the chamber, so that correspondingly large vacuum pumps are necessary and a considerable amount of time is needed after the closing of the chamber before the necessary vacuum has been produced.

The invention is addressed to the problem of improving an induction melting apparatus of the kind described above so that it will be as compact as possible, will be less expensive to manufacture, and require very brief intervals of auxiliary process time.

This problem is solved according to the invention in that the crucible has a cover that closes it hermetically and a tubular downward prolongation in which the mold is disposed so as to be sealed to the interior surface of the prolongation.

With this configuration it is possible to do away entirely with the chamber surrounding the crucible and the mold. It becomes possible, due to the cover and the sealed arrangement of the mold in the prolongation of the crucible to evacuate or to inject an inert gas into the interior of the crucible and mold, in which case the crucible forms the vacuum chamber. Thus the induction melting apparatus is of much more compact construction than comparable apparatus. Furthermore, it can be made ready for operation more quickly. Also, the individual parts of the apparatus are more accessible due to the absence of this enveloping chamber, and this is advantageous in the handling and maintenance of the apparatus.

If it is desired to remelt smaller amounts of metal in a crucible, it is possible by means of the magnetic forces produced by the induction coil to bring the molten metal into a suspended state out of contact with the wall of the crucible. This advantageous "float fusion" can still be achieved even in the case of amounts of several hundred grams of metal if, according to an advantageous embodiment of the invention, the crucible has a funnel-shaped bottom tapering toward its outlet. By means of such a bottom upwardly directed components of the magnetic forces produced by the induction coil can be achieved, resulting in the levitation of the melt.

In larger melting furnaces which cannot operate on the float fusion principle, after the crucible cools off the problem exists of removing the skull from the crucible. It can very easily be pulled out of it if the crucible has a perimeter that increases slightly in diameter toward the top.

One very especially advantageous embodiment of the invention consists in making the mold so as to be able to be raised and lowered in the prolongation. This makes it possible to hold the mold ready in a lower part of the prolongation before pouring, where it is heated increasingly from its bottom up. When the mold has been lifted this results in a directed solidification, which considerably improves the quality of the casting.

The movement of the mold in the prolongation can be achieved in an especially simple manner if it is disposed on a ram extending into the prolongation.

In the case of larger amounts of metal it is no longer possible for the melt to be held by magnetic forces and its surface tension above the outlet of the crucible. It can be kept from flowing out until the desired time for the mold to be filled simply by providing at the outlet of the crucible a plug which can be melted out by an additional heater or by shutting off a cooling system provided for it.

It is also possible, however, in the case of larger amounts of metal, to prevent premature outflow of the melt by providing the mold with a connection for connecting it to a vacuum or an inert gas.

SUMMARY OF THE INVENTION

In accordance with the invention, induction melting apparatus closed off from the atmosphere for melting reactive metals with a high melting point comprises: a connection for attachment to a vacuum source or inert gas source, an unlined metal crucible, an induction coil encompassing the crucible, and a mold disposed under the crucible beneath an outlet, the crucible having a cover closing the crucible hermetically and having a downwardly pointed, tubular prolongation having an interior surface and a mold in the prolongation so disposed as to be sealed to the interior surface of the prolongation.

For a better understanding of the invention, together with other and further objects thereof, reference is made to the following description, taken in connection with the accompanying drawings, and its scope will be pointed out in the appended claims.

BRIEF DESCRIPTION OF THE DRAWING

Referring now to the drawing.

DESCRIPTION OF A PREFERRED EMBODIMENT

Figure 1:
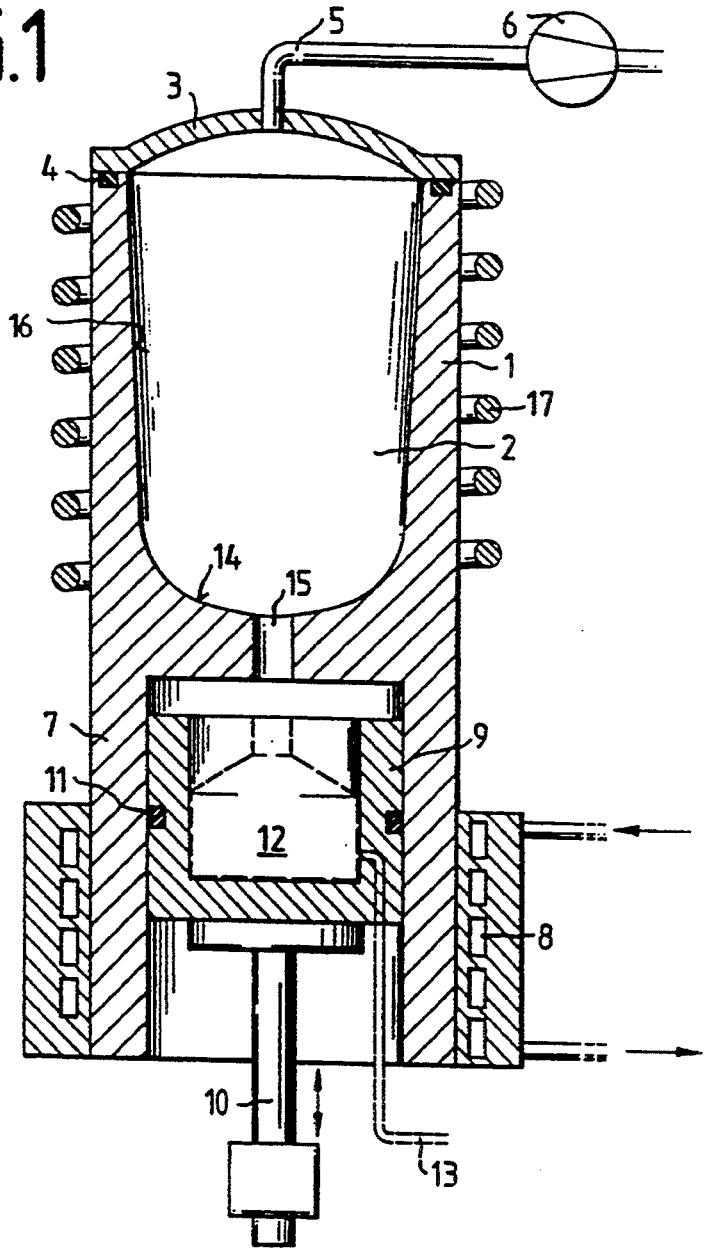
FIG. 1 is a vertical section through an induction melting apparatus according to the invention, and in FIG. 2 is a section through a part of an induction melting apparatus according to FIG. 1 with a modification.

The induction melting apparatus represented in FIG. 1 has a crucible 1 preferably of copper, which has no lining and forms a crucible chamber 2. It is not shown that the wall of the crucible consists of individual water-cooled palisades around the crucible chamber 2 and in this regard it is constructed in accordance with U.S. Pat. No. 4,738,713.

It is important for the invention that the crucible 1 has a cover 3 closing it hermetically and supported with the interposition of a gasket 4 so as to be removable upwardly from the crucible 1. This cover 3 has a connection 5 to which a vacuum source 6 or an inert gas source can be connected.

At the bottom the crucible 1 has as a prolongation 7, which as a rule is cylindrical, and is surrounded by a water cooling system 8. Within this prolongation 7 a mold 9 is disposed for raising and lowering by means of a ram 10. It is important that this mold is sealed against the internal periphery of the prolongation 7 by a circumferential gasket 11. This mold has an interior chamber 12 which has the negative shape of the casting to be produced, and in the case of larger induction melting apparatus it can be connected at 13 to a vacuum or to a source of pressure.

The crucible 1 has a bottom 14 which slopes toward a central outlet 15, and which in this embodiment is of hemispherical shape. The bottom 14, however, could also, for example, be conical in shape. The bottom 14 merges with an internal periphery 16 which expands conically upward to the cover 3. A conventional induction coil 17 serves for heating the crucible 1.

The metal to be melted and cast is placed in the crucible chamber 2 after removing the cover 3. After cover 3 is closed the crucible chamber is evacuated, and with it the interior 12 of the mold 9. Alternatively, it is also possible to provide the cover 3 with an air lock, so that it does not have to be removed and the vacuum in the interior of the melting apparatus will be maintained while it is being charged.

When the induction coil 17 is energized, such strong magnetic forces are created that the molten metal that develops does not contact the internal periphery 16 and the bottom 14 of the crucible 1. Thus no molten metal flows down through the outlet 15. During the melting process the mold 9 is in a lowered position within the prolongation 7. It is therefore heated more in its upper part than in its lower part. If the melting process is to begin, it is raised by the ram 10 upwardly until it comes against the outlet 15. If the current is cut off from the induction coil 17, the magnetic forces holding the melt in suspension collapse. The melt can therefore flow through outlet 15 into the chamber 12 and thus fill the mold 9.

Figure 2:
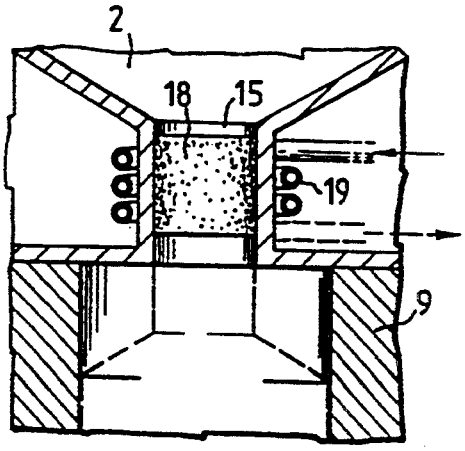

FIG. 2 shows that the outlet 15 can also be closed by a plug 18. In this embodiment the outlet 15 in the area of the plug 18 is surrounded by a cooling coil 19 through which water runs. As long as the cooling coil 19 is in operation the plug 18 stops the outlet 15. If the cooling coil 19 is turned off, the plug 18 becomes so hot that it melts away and thus opens the outlet 15 so that the molten metal can flow into the mold 9.

It is also possible, of course, to make the plug 18 from a material which withstands the temperatures involved. Then, instead of the cooling coil 19, a heating means must be provided, which can be an induction coil which is to be disposed exactly like the cooling coil 19. If such a plug 18 is to melt away, this heating means must be turned on.

While there have been described what are considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claim is:

1. Induction melting apparatus closed off from the atmosphere for melting reactive metals with a high melting point comprising: a connection for attachment to a vacuum source or inert gas source, an unlined metal crucible, an induction coil encompassing the crucible, and a mold disposed under the crucible beneath an outlet, the crucible having a cover closing the crucible hermetically and having a downwardly pointed, tubular prolongation having an interior surface and having the mold disposed in the prolongation and disposed to be sealed to the interior surface of the prolongation.

2. Induction melting apparatus according to claim 1, in which the crucible has an outlet and a funnel-shaped bottom sloping toward the outlet.

3. Induction melting apparatus according to claim 1, in which the crucible has an interior surface having a circular cross section and increasing in diameter toward the top.

4. Induction melting apparatus according to claim 1, in which the mold is disposed for raising and lowering in the prolongation.

5. Induction melting apparatus according to claim 4, which has a vertically movable ram reaching into the prolongation and in which the mold is disposed on the vertically movable ram reaching into the prolongation.

6. Induction melting apparatus according to claim 2, which has disposed in the outlet of the crucible a plug which is melted away by one of the group consisting of an additional heating means and means for shutting off a cooling means.

7. Induction melting apparatus according to claim 1, in which the mold has a connection for connecting to vacuum or pressure.

8. Induction melting apparatus according to claim 1, in which the cover has said connection for connecting the cover to a vacuum source or inert gas source.

* * * * *